US012687031B2

(12) United States Patent
Geissman et al.

(10) Patent No.: US 12,687,031 B2
(45) Date of Patent: Jul. 21, 2026

(54) MASONRY LINTEL SYSTEM

(71) Applicant: Adena Masonry LLC, Mansfield, OH (US)

(72) Inventors: Brad P. Geissman, New Washington, OH (US); Spencer Shipman, Galion, OH (US)

(73) Assignee: Adena Masonry LLC, Mansfield, OH (US)

( * ) Notice: Subject to any disclaimer, the term of this patent is extended or adjusted under 35 U.S.C. 154(b) by 299 days.

(21) Appl. No.: 18/458,400

(22) Filed: Aug. 30, 2023

(65) Prior Publication Data

US 2025/0075520 A1 Mar. 6, 2025

(51) Int. Cl.
*E04G 23/02* (2006.01)

(52) U.S. Cl.
CPC ..... *E04G 23/0274* (2013.01)

(58) Field of Classification Search
CPC ..... E04G 21/1841; E04G 21/1858; E04G 23/0274; E04C 2003/023
USPC ..... 52/118, 289, 702
See application file for complete search history.

(56) References Cited

U.S. PATENT DOCUMENTS 796,433 A * 8/1905 Kahn ..... F16B 9/05 248/300
829,234 A * 8/1906 Seipp ..... E04B 1/2612 52/702
832,133 A * 10/1906 Lanz ..... E04B 1/2612 52/703
1,007,759 A * 11/1911 Whitney ..... E04B 1/2612 182/229
2,386,161 A * 10/1945 Hawes ..... E04G 17/16 248/200.1
2,914,814 A * 12/1959 Christian ..... E04F 21/0015 52/127.2
2,974,762 A * 3/1961 Hunnebeck ..... E04G 11/56 52/645
3,090,329 A * 5/1963 Rolfe, Jr. ..... B61D 45/001 410/148
3,108,663 A * 10/1963 Glaser ..... E04G 11/50 52/289
3,124,223 A * 3/1964 Kisovec ..... E04G 11/56 52/261
3,141,533 A * 7/1964 Below ..... E06B 3/988 52/217
3,325,957 A * 6/1967 Demeules ..... E04G 11/56 52/694
3,680,711 A * 8/1972 Brucker ..... E04B 9/122 52/632

(Continued)

FOREIGN PATENT DOCUMENTS

CA 2673813 A1 * 1/2010 ..... E04B 1/2612
CN 110630029 A * 12/2019 ..... E04G 23/02

(Continued)

*Primary Examiner* — Ryan D Kwiecinski
(74) *Attorney, Agent, or Firm* — Emerson, Thomson & Bennett, LLC; Roger D. Emerson; Peter R. Detorre

(57) ABSTRACT

Provided is a masonry lintel system containing a C-channel, bar stock, angle brace, and plurality of threaded bolts. A C-beam may rest upon the threaded bolts, allowing the C-beam to be installed to span an opening in a CMU masonry wall. The lintel system may thereby be removed from the masonry wall, after C-beam installation.

19 Claims, 9 Drawing Sheets

(56) References Cited

U.S. PATENT DOCUMENTS 3,993,282 A * 11/1976 Berman ..... E04G 11/56 249/24
4,223,866 A * 9/1980 Black ..... E04G 17/18 249/211
4,342,440 A * 8/1982 Eyden ..... E04G 17/18 249/19
4,348,002 A * 9/1982 Eyden ..... E04G 17/16 249/19
4,348,004 A * 9/1982 Eyden ..... E04G 17/16 249/210
4,349,491 A * 9/1982 Eyden ..... E04G 17/16 249/19
4,684,097 A * 8/1987 Cox ..... E04B 1/34336 248/354.3
5,537,805 A * 7/1996 Allman ..... E04G 21/1866 52/749.15
5,711,122 A * 1/1998 Lee ..... E04G 17/16 52/707
5,803,653 A * 9/1998 Zuffetti ..... E04C 3/07 52/645
6,128,883 A * 10/2000 Hatzinikolas ..... E04B 1/4178 52/378
7,363,722 B1 * 4/2008 Brinkmoeller ..... E04F 21/1855 33/573
7,546,718 B2 * 6/2009 Vasta ..... E04G 21/1841 52/645
8,186,112 B2 * 5/2012 Studebaker ..... F16B 5/0275 52/204.2
8,186,122 B2 * 5/2012 Studebaker ..... F16B 25/103 52/274
8,234,827 B1 * 8/2012 Schroeder, Sr. ..... E04B 1/24 52/638
8,261,509 B2 * 9/2012 Harkin ..... E04G 23/0237 52/645
8,490,340 B2 * 7/2013 Hatzinikolas ..... E04B 1/94 52/99
8,955,263 B2 * 2/2015 Hatzinikolas ..... E04B 1/941 52/99
9,841,140 B2 * 12/2017 Kennedy ..... E04G 23/04
10,012,001 B2 * 7/2018 Kennedy ..... E04G 23/0296
10,280,618 B2 * 5/2019 Kelly ..... E04C 3/07
10,920,435 B2 * 2/2021 Kennedy ..... E04G 23/0296
11,078,667 B2 * 8/2021 Kelly ..... E04C 3/07
11,499,328 B2 * 11/2022 Ovalle ..... E04C 3/005
11,619,046 B2 * 4/2023 Sessler ..... E04B 2/76 52/846
11,692,363 B2 * 7/2023 Kennedy ..... E04G 23/0274 52/126.1
12,123,207 B2 * 10/2024 Kennedy ..... E04G 23/0296
2002/0020135 A1 * 2/2002 Grove, Jr. ..... E04G 23/02 52/480
2006/0010809 A1 * 1/2006 Lafreniere ..... E04B 2/766 52/489.1
2006/0096192 A1 * 5/2006 Daudet ..... E04C 3/11 52/204.1
2006/0174583 A1 * 8/2006 Brady ..... E04B 2/766 52/846
2007/0089374 A1 * 4/2007 Vasta ..... E04C 3/07 52/204.2
2008/0172976 A1 * 7/2008 Carney ..... E04B 5/12 52/702
2009/0100796 A1 * 4/2009 Denn ..... E04B 1/18 52/745.12
2014/0260070 A1 * 9/2014 Barcroft ..... B66F 3/00 52/741.1
2016/0319556 A1 * 11/2016 Kennedy ..... E04G 23/04
2017/0073970 A1 * 3/2017 Weber ..... E06B 1/52
2019/0048577 A1 * 2/2019 Studer ..... E04B 1/003
2019/0048589 A1 * 2/2019 Kelly ..... E04C 3/07
2019/0211575 A1 * 7/2019 Kennedy ..... E04G 23/0296
2020/0385988 A1 * 12/2020 Kelly ..... E04C 3/005
2021/0062497 A1 * 3/2021 Deans ..... E04B 1/388
2021/0164247 A1 * 6/2021 Kennedy ..... E04G 23/0274
2022/0018131 A1 * 1/2022 Sessler ..... E04B 2/76
2023/0340794 A1 * 10/2023 Kennedy ..... E04G 23/0274
2024/0301694 A1 * 9/2024 Kelly ..... E04C 3/04
2025/0075520 A1 * 3/2025 Geissman ..... E04G 23/0274

FOREIGN PATENT DOCUMENTS

CN 110847627 A * 2/2020 ..... E04G 23/0274
CN 112282408 A * 1/2021 ..... E04G 23/0274
DE 20002652 U1 * 4/2000 ..... E04G 21/1841
DE 202006002131 U1 * 6/2006 ..... E04G 23/0274
FR 2930794 A1 * 11/2009 ..... E04C 3/02
GB 2103680 A * 2/1983 ..... E04B 1/7046
GB 2114626 A * 8/1983 ..... E02D 27/48
GB 2205875 A * 12/1988 ..... E04G 23/0274
GB 2226070 A * 6/1990 ..... E04C 3/02
GB 2237320 A * 5/1991 ..... E04G 23/0274
GB 2246157 A * 1/1992 ..... E04G 23/0274
GB 2254362 A * 10/1992 ..... E04G 23/0274
GB 2271601 A * 4/1994 ..... E04G 23/0274
GB 2296028 A * 6/1996 ..... E04G 25/00
GB 2332013 A * 6/1999 ..... E04G 23/0274
GB 2413353 A * 10/2005 ..... E04G 23/0274
GB 2485147 A * 5/2012 ..... F16M 13/00
GB 2485153 A * 5/2012 ..... E04C 3/02
GB 2506656 A * 4/2014 ..... E04G 23/0274
GB 2523628 A * 9/2015 ..... E04G 21/1825
GB 2543937 A * 5/2017 ..... E04G 23/06
GB 2593822 A * 10/2021 ..... E04C 3/02
NL 8000075 A * 12/1980 ..... E04G 21/1883
WO WO-2004111361 A1 * 12/2004 ..... E04G 21/1841

* cited by examiner

MASONRY LINTEL SYSTEM

I. BACKGROUND

A. Field of the Invention

The present subject matter is directed to apparatuses and methods regarding masonry and construction. More specifically, the present subject matter is directed to apparatuses and methods for temporary support of concrete masonry bond beam blocks across openings in masonry walls.

B. Description of Related Art

When constructing buildings, spanning wall gaps become a substantial issue. The construction project naturally contemplates doors, windows, and other openings. These portals require wall sections be built on either side but also necessitate "closing the gap" formed above the side sections, to complete the door, window, etc. Blocks would need to be laid across the open space and held in place long enough for a binding agent to set in and ultimately hold the block beam aloft. Doing so quickly and inexpensively forms the basis of much research and effort.

The first solution to this problem involved the use of telescoping beam sections. The extending sections would bridge the gap between two walls and serve as a platform upon which blocks could be set. Unfortunately, the beam sections are costly to manufacture and purchase. Additionally, the beam sections may not extend far enough to support the desired width of the opening being constructed.

The present invention addresses these concerns by providing a lintel system that can inexpensively bridge gaps of any desired size and width. The lintel system allows a bricklayer to lay the concrete masonry bond beam units across the opening and provides temporary support. Once the bond beam lintel has been grouted and it has cured to its designed strength, the unique design of the invention allows the temporary support structure of the lintel system to be easily removed without any damage to the masonry wall. An additional advantage of the invention is that it is reusable and can be adapted to nearly any size of opening in a CMU masonry wall using the same device. A "CMU" is a concrete masonry unit. A CMU is a standard-size rectangular block used in building construction. CMUs are some of the most versatile building products available because of the wide variety of appearances that can be achieved using them. In non-technical usage, the terms cinder block and breeze block are often generalized to cover all these varieties.

Overall, the invention described allows bricklayers and construction workers to lay concrete masonry bond beam units quickly, simply, and inexpensively across an opening and provide temporary support in furtherance of the activities described above.

II. SUMMARY

In accordance with one aspect of the present invention, a lintel system comprising a C-channel having a first vertical edge and a second vertical edge opposite the first edge, a jamb section and a bracing section disposed beneath the jamb section, and a anterior face and a posterior face opposite the anterior face. Wherein, the jamb and bracing sections extend distally from the anterior face and span the length of the C-channel from the first vertical edge to the second vertical edge, and the bracing section is narrower in width than the jamb section. The lintel system also comprises a bar stock, disposed on the anterior face and spanning the length of the C-channel from the first vertical edge to the second vertical edge, and an angle brace, disposed on the posterior face and extending distally from the posterior face. Said brace having a horizontally oriented placement surface, a plurality of through-holes disposed on the placement surface, and a plurality of threaded bolts corresponding to the angle brace through-holes.

In accordance with another aspect of the present invention, the lintel system above, wherein the threaded bolts are engaged with the angle brace through-holes to selectively twist within the through-holes between a lifting position and a lowering position. The lintel system above, wherein the jamb section is tapered. The lintel system above, wherein the bar stock comprises rounded edges. The lintel system above, wherein the angle brace is longer than the length of the C-channel. The lintel system above, wherein the angle brace is shorter than the length of the C-channel. The lintel system above, wherein the angle brace further comprises a bottom surface and wherein the threaded bolts enter the angle brace through-holes from the bottom surface to apply a force to the C-beam. The lintel system above, wherein the jamb section is configured to rest atop a masonry wall jamb, the jamb section is selectively removable from the wall jamb. The lintel system above, wherein the lintel system further comprises a C-beam, wherein the C-beam is installed to span an opening in a wall and rests upon the threaded bolts. The lintel system herein, wherein the wall is a CMU masonry wall or a brick wall.

In accordance with another aspect of the present invention, a method of laying concrete masonry bond beam units across an opening, the steps comprising providing two lintel systems, each comprising a C-channel having a first vertical edge and a second vertical edge opposite the first edge, a jamb section and a bracing section disposed beneath the jamb section, a anterior face and a posterior face opposite the anterior face, wherein the jamb and bracing sections extend distally from the anterior face and span the length of the C-channel from the first vertical edge to the second vertical edge, wherein the bracing section is narrower in width than the jamb section. A bar stock disposed on the anterior face, spanning the length of the C-channel from the first vertical edge to the second vertical edge, an angle brace disposed on the Posterior face and extending distally from the Posterior face, said brace having a horizontally oriented placement surface, a plurality of through-holes disposed on the placement surface, and a plurality of threaded bolts corresponding to the angle brace through-holes. Wherein, the threaded bolts are engaged with the angle brace through-holes to selectively twist within the through-holes between a lifting position and a lowering position. Providing an opening in a CMU masonry wall, said opening having a first side and a second side, installing a lintel system on each of the opening first side and opening second side, installing a C-beam atop the angle brace placement surface of both lintels, twisting the threaded bolts to a lifting position to engage the lintels with the C-beam, raising the C-beam to a height corresponding to the height of the CMU masonry wall, laying concrete masonry bond beam units across the C-beam, grouting and curing the bond beam units, twisting the threaded bolts to a lowering position to disengage the lintel from the C-beam, removing the C-beam from the tops of the lintels' angle brace surfaces, and removing the lintel jamb sections from the wall jambs.

In accordance with another aspect of the present invention, the method, wherein the lintel system jamb sections are tapered. The method above, wherein the lintel system angle braces are longer than the lengths of the C-channels. The method above, wherein the lintel system angle braces are shorter than the lengths of the C-channels. The method above, wherein the bar stock comprises rounded edges.

In accordance with another aspect of the present invention, a lintel system comprising a C-channel having a first vertical edge and a second vertical edge opposite the first edge, a jamb section and a bracing section disposed beneath the jamb section, wherein the jamb section is tapered, said jamb section is configured to rest atop a masonry wall jamb, and the jamb section is selectively removable from the wall jamb. Included is an anterior face and a posterior face opposite the anterior face, wherein the jamb and bracing sections extend distally from the anterior face and span the length of the C-channel from the first vertical edge to the second vertical edge. Wherein, the bracing section is narrower in width than the jamb section. Included is a bar stock disposed on the anterior face, spanning the length of the C-channel from the first vertical edge to the second vertical edge, and an angle brace disposed on the posterior face and extending distally from the posterior face. Said brace having a horizontally oriented placement surface, a plurality of through-holes disposed on the placement surface, wherein the angle brace is longer than the length of the C-channel, and a plurality of threaded bolts corresponding to the angle brace through-holes. Wherein, the threaded bolts are engaged with the angle brace through-holes to selectively twist within the through-holes between a lifting position and a lowering position. A C-beam is installed to span an opening in a CMU masonry wall, and the C-beam rests upon the threaded bolts.

Still other benefits and advantages of the invention will become apparent to those skilled in the art to which it pertains upon a reading and understanding of the following detailed specification.

III. BRIEF DESCRIPTION OF THE FIGURES

The above drawings form part of the disclosure and specification and are included to further demonstrate certain aspects of the invention, which aspects will be described in detail later in this specification. The invention may be better understood by reference to these drawings in conjunction with the detailed description.

IV. DETAILED DESCRIPTION

Figure 1:
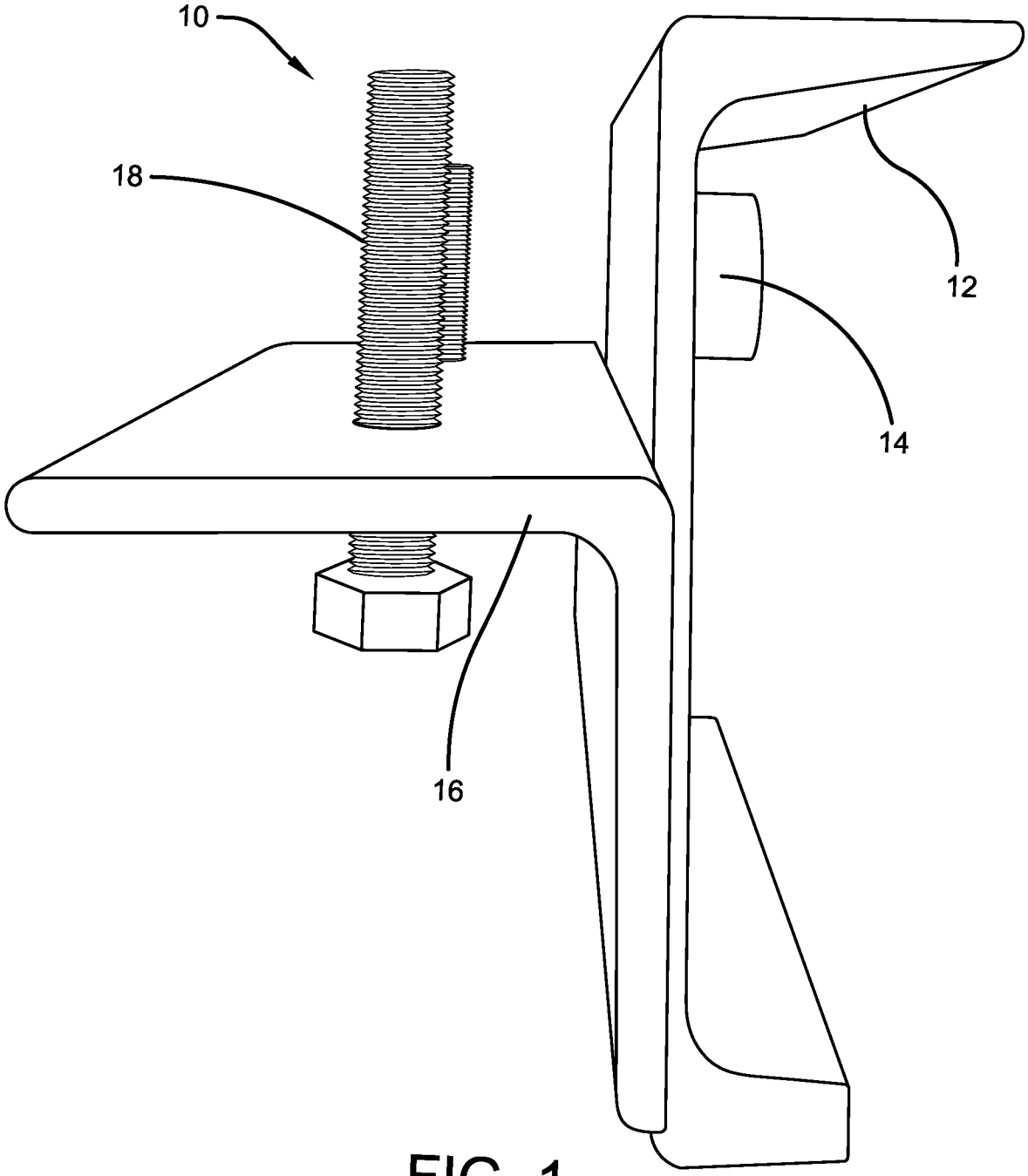
FIG. 1 is a left side view of the lintel system.
Figure 2:
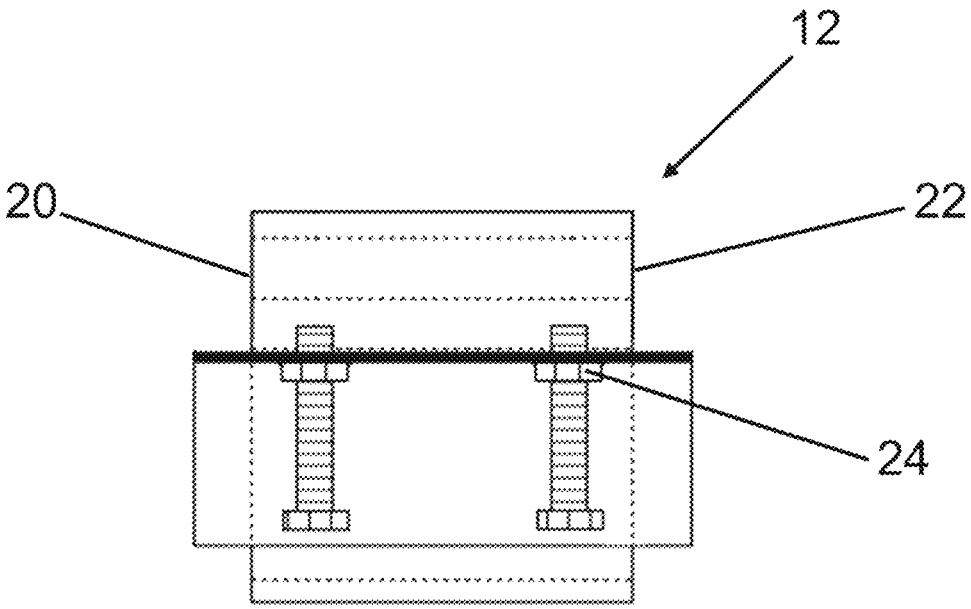
FIG. 2 is a front view of the lintel system.
Figure 3:
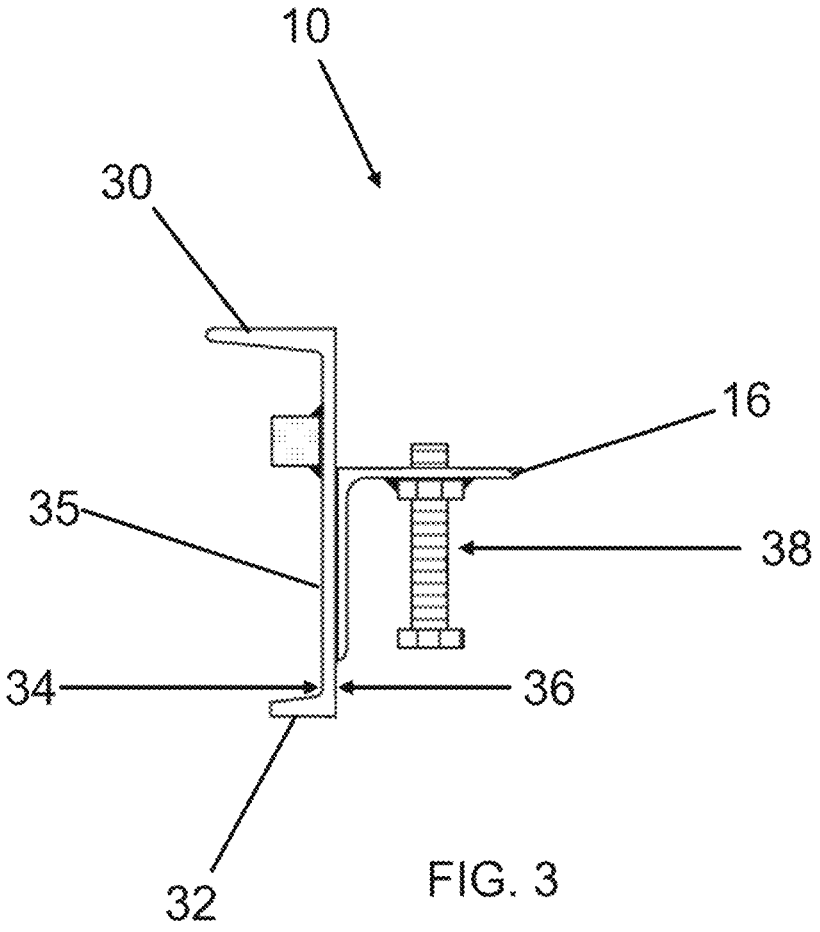
FIG. 3 is a right side view of the lintel system.
Figure 4:
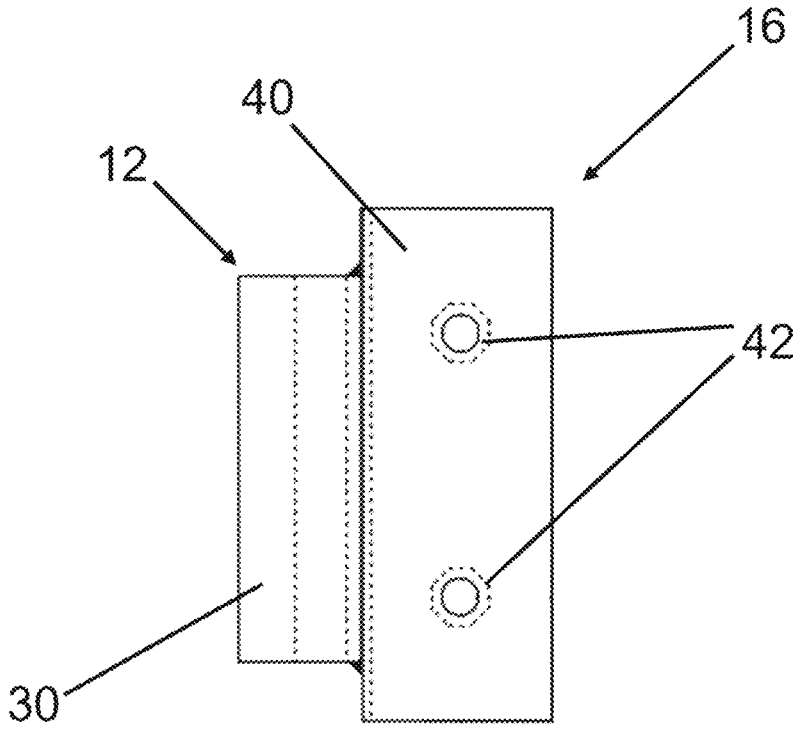
FIG. 4 is a top view of the lintel system.
Figure 5:
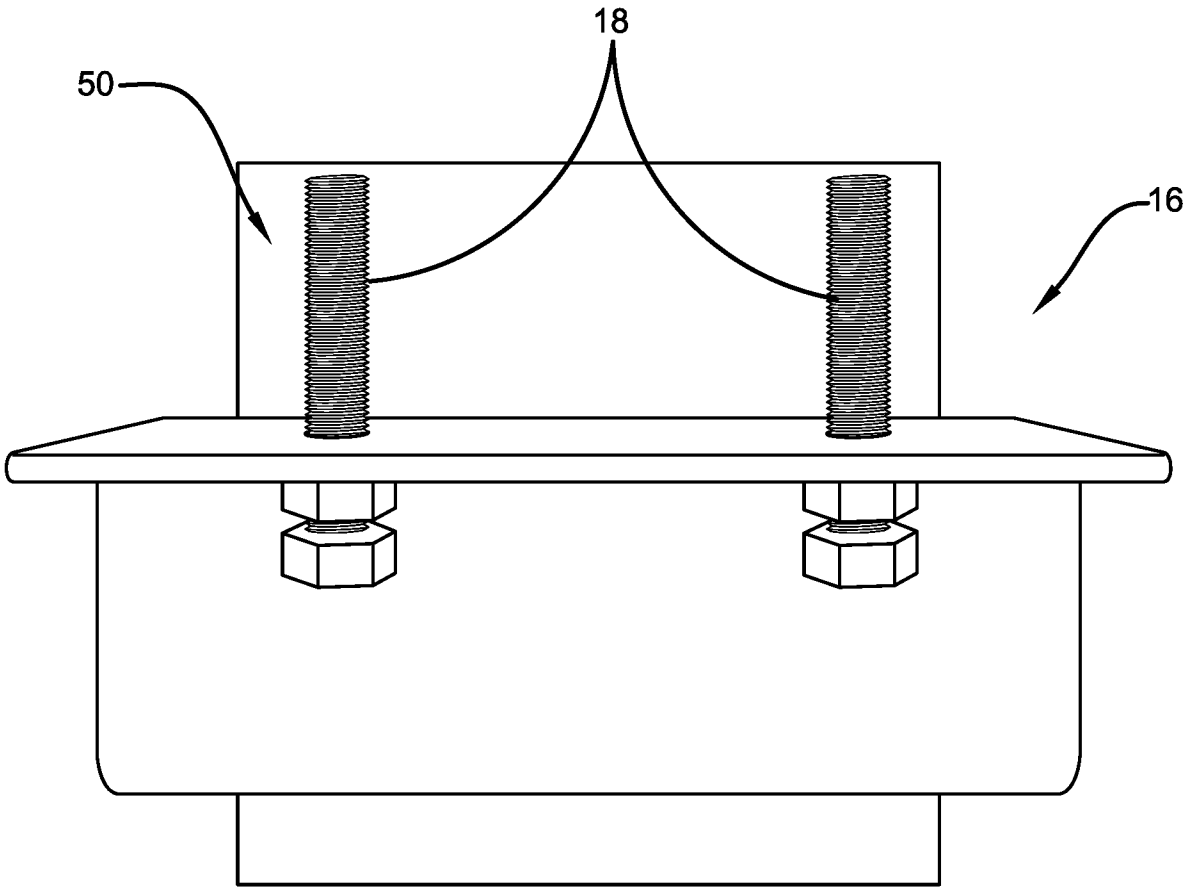
FIG. 5 is a front view of the lintel system, with the bolts in the lifting position.
Figure 6:
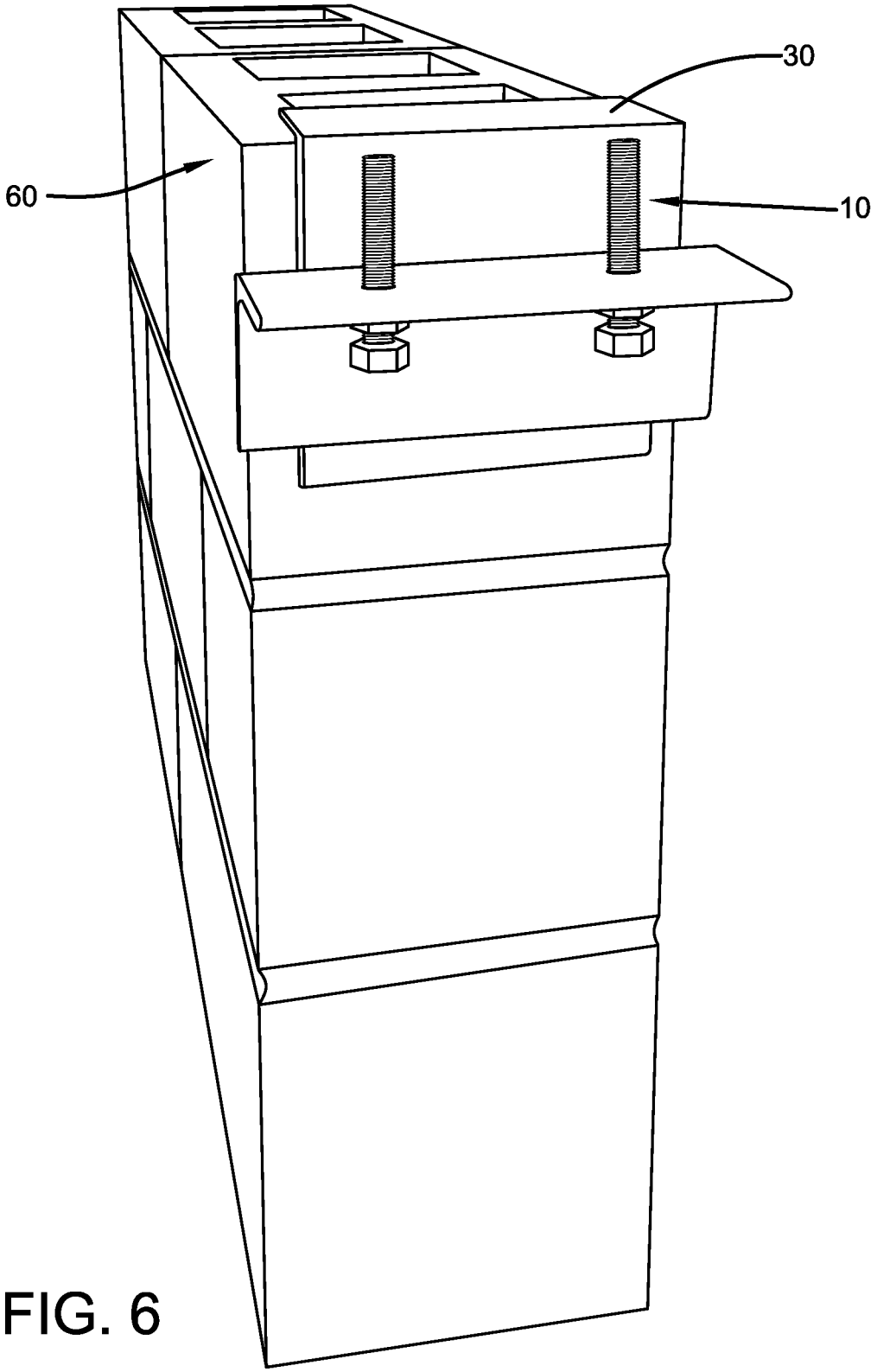
FIG. 6 is a lintel system installed onto a wall jamb.
Figure 7:
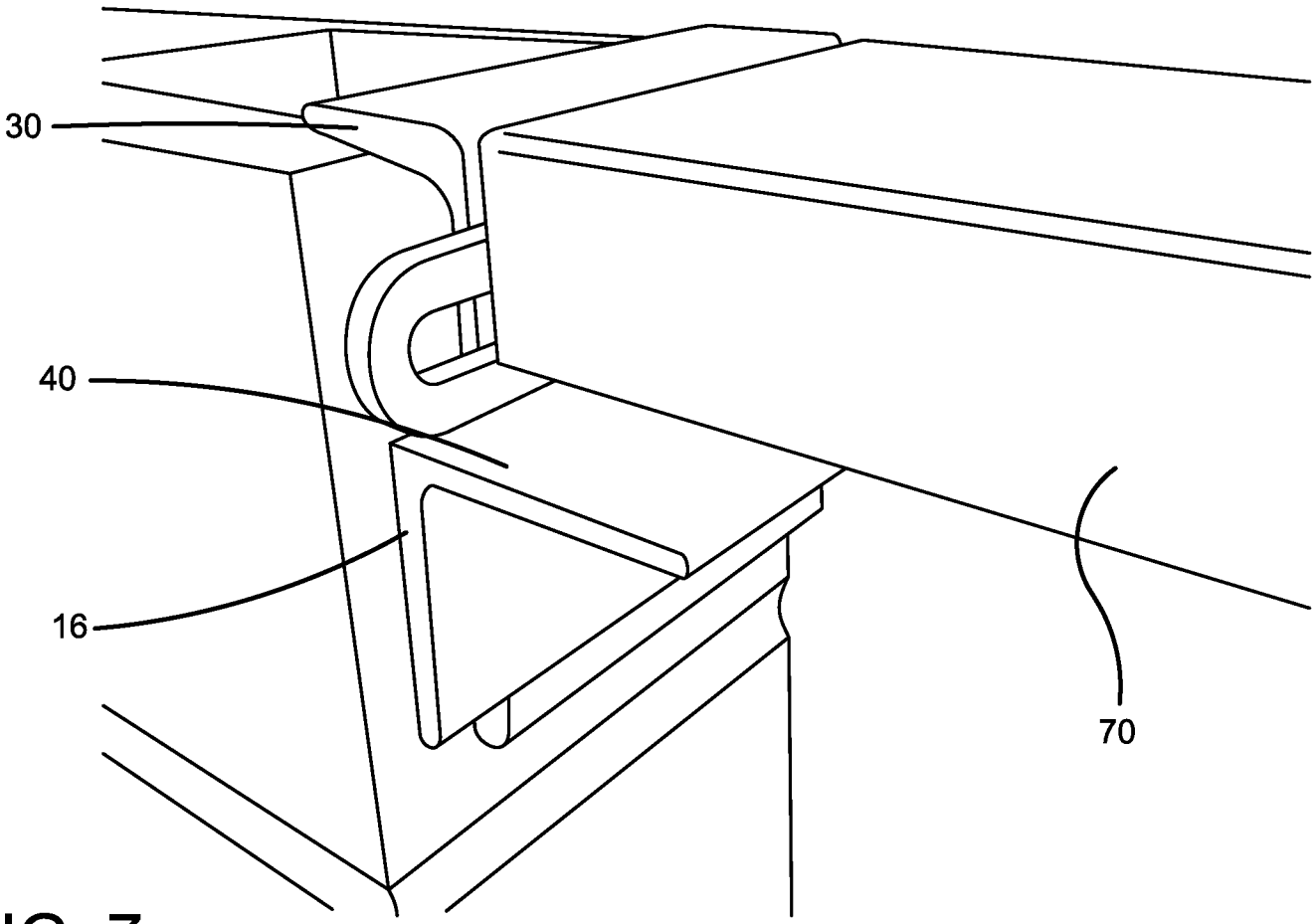
FIG. 7 is a close view of a C-beam set onto an angle brace placement surface.
Figure 8:
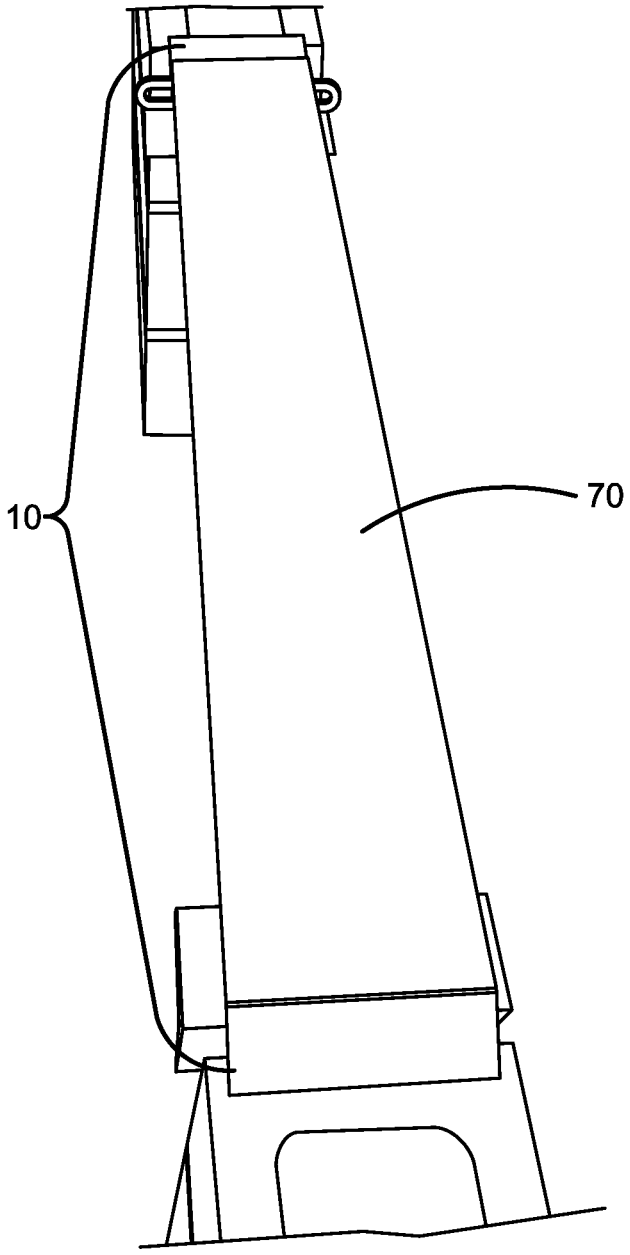
FIG. 8 is a top view of a C-beam, spanning a wall opening, supported by two lintels.

Referring now to the drawings, wherein the showings are for purposes of illustrating embodiments of the invention only and not for purposes of limiting the same, and wherein like reference numerals are understood to refer to like components, FIG. 1 shows a masonry lintel system 10 according to some embodiments of the present subject matter. The lintel system 10 may contain a C-channel 12, bar stock 14, angle brace 16, and plurality of threaded bolts 18. In a particular embodiment, the lintel system may further contain a C-beam, which may rest upon the threaded bolts 18, as described in detail below.

With reference to FIGS. 1-5, the C-channel 12 can have a first vertical edge 20 and a second vertical edge 22 opposite the first, a jamb section 30 and a bracing section 32 beneath the jamb section 30, and a connecting section 35 for connecting the jamb section 30 and the bracing section 32. The connection section 35 includes an anterior face 34 and a posterior face 36. The jamb 30 and bracing 32 sections can extend outward from the anterior face 34 and span the length of the C-channel 12, and the bracing section 32 may be narrower in width than the jamb section 30—the bracing section 32 may be approximately half the width of the jamb section 30 but may be narrower by any amount chosen by a person having skill in the art and according to sound engineering judgment. In one embodiment, the jamb section 30 can be up to two (2) inches in width, and the bracing section 32 up to one (1) inch in width. The first 20 and second 22 vertical edges may be up to six (6) inches in length, and the length of the C-channel 12 from first 20 to second 22 edge may be up to six (6) inches long, in a similar embodiment. The jamb section 30 can be configured to rest atop a masonry wall jamb and can be selectively removable from that wall jamb, as described in detail below. In a particular embodiment, the jamb section 30 may be tapered to allow for faster and easier removal of the lintel 10 from the wall jamb, as described below.

With continued reference to FIGS. 1-5, the bar stock 14 can be disposed on the anterior face 34 and may span the full length of the C-channel 12. In a particular embodiment, the bar stock 14 may have rounded edges, or may also be composed of square stock, but can be shaped according to sound engineering judgment. In a particular embodiment, the bar stock 14 can be three-quarters (¾) inch round bar stock.

With continued reference to FIGS. 1-5, the angle brace 16 can be disposed on, or affixed to, the Posterior face 36 and can extend distally from the Posterior face 36. The angle brace 16 may have a horizontally oriented placement surface 40, which may contain a plurality of through-holes 42 disposed on the placement surface 40. In a particular embodiment, each of the through-holes 42 may contain a threaded nut 24 disposed on the surface opposite the placement surface 40 and welded to the brace 16, aligned with each of the through-holes 42. The through-holes 42 may be threaded. The angle brace 16 can be longer, shorter, or the same length as the C-channel 12. In a particular embodiment, the angle brace 16 can be up to eight (8) inches in length, up to three (3) inches in height, and up to three (3) inches in width.

With continued reference to FIGS. 1-5, the threaded bolts 18 may correspond to the angle brace through-holes 42 (or welded nuts, depending on the embodiment). The bolts 18 can be engaged with the angle brace 16 to selectively twist between a lowering position 38 and a lifting position 50. In a particular embodiment, the threaded bolts 18 can engage with the angle brace 16 in an upside-down fashion, with the bolt heads facing downwards, and the bolt threaded ends facing upwards.

Figure 9:
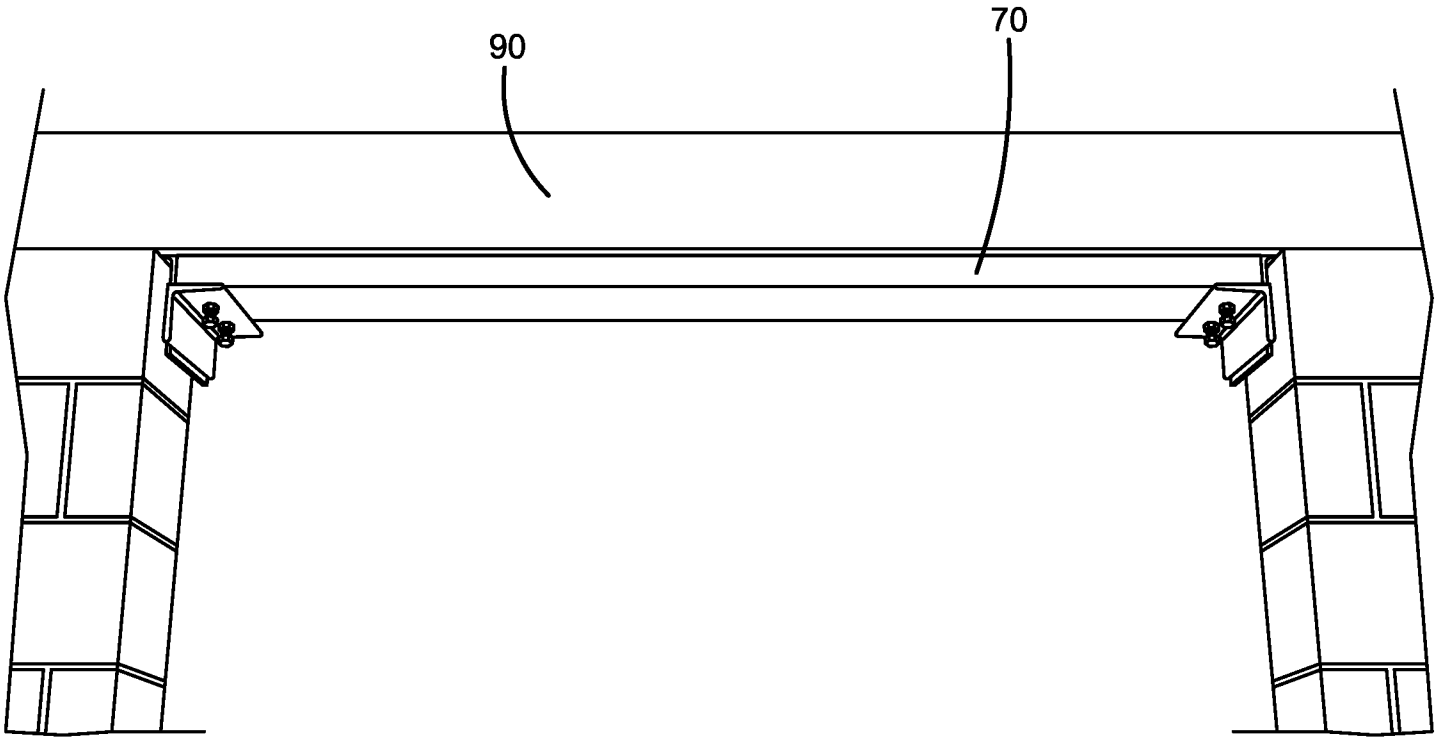
FIG. 9 is a side view of the C-beam and lintels supporting concrete masonry bond beam units across an opening.

With reference now to FIGS. 1-9, the components of the masonry lintel system 10 may operate to lay concrete masonry bond beam units across an opening, in accordance with a particular embodiment of the invention. A C-channel jamb section 30 can be placed atop a wall jamb 60 on either side of the opening, which wall can be composed of different materials, for example CMU masonry material or brick. The bracing section 32 and bar stock 14 support the lintel 10 against the side of the opening. A C-beam 70 can be installed to span the two sides of the wall opening, the C-beam 70 resting on the angle brace placement surface 40 on each side of the opening. The threaded bolts 18 may engage with the angle brace through-holes 42 or welded nuts on the C-channel 12. After the C-beam 70 rests on the placement surface 40, the bolts 18 can twist within the through-holes 42 between a lowering position 38 and a lifting position 50 to engage the C-beam 70, raising or lowering the beam 70 until a proper height is reached. The height may generally correspond to the height of the wall jamb 60. Once in place, concrete masonry bond beam units 90 can be laid across the C-beam 70, spanning the opening. Once the bond beam units are grouted and cured, the C-beam 70 can be removed by twisting the threaded bolts 18 to the lowering position 38 to disengage the C-beam 70 from the rest of the lintel system 10 and removing the C-beam 70 from the angle brace placement surfaces 40. Finally, the lintel jamb sections 30 can be removed from the wall jamb 60 on either side of the opening. The jamb section 30 may be removed by moving the lintel system 10 bracket inward toward center of the opening. The resting edge of the jamb section 30 may be tapered, such that once the C-beam 70 is removed, an individual can simply remove the lintel system 10 bracket from its temporary resting position by hand. FIG. 9 shows a horizontal joint being tooled during construction. A small gap may be located on the underside of the constructed CMU bond beam only where jamb section 30 was installed. That gap can be filled and tooled once removed for aesthetics.

Numerous embodiments have been described, hereinabove. It will be apparent to those skilled in the art that the above methods and apparatuses may incorporate changes and modifications without departing from the general scope of the present subject matter. It is intended to include all such modifications and alterations in so far as they come within the scope of the appended claims or the equivalents thereof.

We claim:

1. A lintel system comprising:

a C-channel having:

a jamb section configured to rest atop a masonry wall jamb and selectively removable from that wall jamb;

a bracing section disposed beneath the jamb section;

a connecting section for connecting the jamb section and the bracing section, wherein the connecting section includes an anterior face and a posterior face opposite the anterior face;

wherein the jamb and bracing sections extend distally from the anterior face and span the length of the C-channel;

a bar stock, disposed on the anterior face, for displacing the anterior face from the masonry wall jamb;

an angle brace, disposed on the posterior face and extending distally from the posterior face, said brace having a horizontally oriented placement surface and a plurality of through-holes disposed on the placement surface; and a plurality of threaded bolts respectively received through the corresponding plurality of through-holes of the angle brace, for supporting a C-beam.

2. The lintel system of claim 1 wherein the threaded bolts are engaged with the angle brace through-holes to selectively twist within the through-holes between a lifting position and a lowering position.

3. The lintel system of claim 1 further comprising:

a plurality of threaded nuts affixed to the underside of the placement surface and aligned with said plurality of through-holes; and said plurality of threaded bolts engaging with the corresponding plurality of threaded nuts to selectively twist within the through-holes between a lifting position and a lowering position.

4. The lintel system of claim 1 wherein the jamb section is tapered.

5. The lintel system of claim 1 wherein the bar stock comprises rounded edges.

6. The lintel system of claim 1 wherein the bracing section is narrower in width than the jamb section.

7. The lintel system of claim 1 wherein the angle brace is longer than the length of the C-channel.

8. The lintel system of claim 1 wherein the angle brace is shorter than the length of the C-channel.

9. The lintel system of claim 1 wherein:

the angle brace further comprises a bottom surface and wherein the threaded bolts enter the angle brace through-holes from the bottom surface to apply a force to the C-beam.

10. The lintel system of claim 1 wherein:

the jamb section is configured to rest atop a masonry wall jamb; and wherein the jamb section is selectively removable from the wall jamb.

11. The lintel system of claim 10 wherein the wall is a CMU masonry wall.

12. The lintel system of claim 10 wherein the wall is a brick wall.

13. The lintel system of claim 1 wherein the lintel system further comprises:

wherein the C-beam is installed to span an opening in a wall; and wherein the C-beam rests upon the threaded bolts.

14. A method of laying concrete masonry bond beam units across an opening, the steps comprising:

providing two lintel systems, each comprising:

a C-channel having:

a jamb section configured to rest atop a masonry wall jamb and selectively removable from that wall jamb;

a bracing section disposed beneath the jamb section;

a connecting section for connecting the jamb section and the bracing section, wherein the connecting section includes an anterior face and a posterior face opposite the anterior face;

wherein the jamb and bracing sections extend distally from the anterior face and span the length of the C-channel;

a bar stock, disposed on the anterior face, for displacing the anterior face from the masonry wall jamb;

an angle brace, disposed on the posterior face and extending distally from the posterior face, said brace having a horizontally oriented placement surface and a plurality of through-holes disposed on the placement surface;

a plurality of threaded bolts respectively received through the corresponding plurality of through-holes of the angle brace, for supporting a C-beam;

wherein the threaded bolts are engaged with the angle brace through-holes to selectively twist within the through-holes between a lifting position and a lowering position;

providing an opening in a CMU masonry wall, said opening having a first side and a second side;

installing a lintel system on each of the opening first side and opening second side;

installing a C-beam atop the angle brace placement surface of both lintels;

twisting the threaded bolts to a lifting position to engage the lintels with the C-beam;

raising the C-beam to a height corresponding to the height of the CMU masonry wall;

laying concrete masonry bond beam units across the C-beam;

grouting and curing the bond beam units;

twisting the threaded bolts to a lowering position to disengage the lintel from the C-beam;

removing the C-beam from the tops of the lintels' angle brace surfaces; and removing the lintel jamb sections from the wall jambs.

15. The method of claim 14 wherein the lintel system jamb sections are tapered.

16. The method of claim 14 wherein the lintel system angle braces are longer than the lengths of the C-channels.

17. The method of claim 14 wherein the lintel system angle braces are shorter than the lengths of the C-channels.

18. The method of claim 14 wherein the bar stock comprises rounded edges.

19. A lintel system comprising:

a C-channel having:

a tapered jamb section configured to rest atop a masonry wall jamb and selectively removable from that wall jamb;

a bracing section disposed beneath the jamb section;

a connecting section for connecting the jamb section and the bracing section, wherein the connecting section includes an anterior face and a posterior face opposite the anterior face;

wherein the jamb and bracing sections extend distally from the anterior face and span the length of the C-channel;

wherein the bracing section is narrower in width than the jamb section;

a bar stock, disposed on the anterior face, for displacing the anterior face from the masonry wall jamb;

an angle brace, disposed on the posterior face and extending distally from the posterior face, said brace having a horizontally oriented placement surface and a plurality of through-holes disposed on the placement surface;

wherein the angle brace is longer than the length of the C-channel;

a plurality of threaded nuts affixed to the underside of the placement surface and aligned with said plurality of through-holes;

a plurality of threaded bolts respectively received through the corresponding plurality of through-holes of the angle brace, for supporting a C-beam;

wherein the threaded bolts are engaged with the corresponding plurality of threaded nuts to selectively twist within the through-holes between a lifting position and a lowering position;

wherein the C-beam is installed to span an opening in a CMU masonry wall; and wherein the C-beam rests upon the threaded bolts.

* * * * *